US006352495B1

(12) United States Patent
Hsu

(10) Patent No.: US 6,352,495 B1
(45) Date of Patent: Mar. 5, 2002

(54) LEG STRETCHING DEVICE

(76) Inventor: Frank Hsu, No. 22, Lane 23, Chung-Yang Rd., Yung-Kang City, Tainan Hsien (TW)

( * ) Notice: Subject to any disclaimer, the term of this patent is extended or adjusted under 35 U.S.C. 154(b) by 0 days.

(21) Appl. No.: 09/845,132

(22) Filed: Apr. 30, 2001

(51) Int. Cl.[7] ..... A63B 21/00; A63B 23/00
(52) U.S. Cl. ..... 482/92; 482/131; 482/907
(58) Field of Search ..... 482/92, 97, 142, 482/907, 131, 133, 138, 145, 148

(56) References Cited

U.S. PATENT DOCUMENTS 4,445,684 A * 5/1984 Ruff ..... 482/131
4,781,373 A * 11/1988 Irwin ..... 482/131
4,877,239 A * 10/1989 Rosa ..... 482/131
5,026,049 A * 6/1991 Goodman ..... 482/131
5,137,504 A * 8/1992 Mangini ..... 482/131
5,584,756 A * 12/1996 Grapengiser et al. ..... 482/92
5,904,641 A * 5/1999 Huang ..... 482/131

* cited by examiner

*Primary Examiner*—Stephen R. Crow
(74) *Attorney, Agent, or Firm*—Akin, Gump, Strauss, Hauer & Feld, L.L.P.

(57) ABSTRACT

A leg stretching device includes a base unit, a connecting frame, a control mechanism, and a pair of leg support rods. The control mechanism includes a slide rod having a frame connecting portion mounted non-rotatably on the connecting frame, and a rack portion extending slidably into a stationary tube of the base unit. A ratchet wheel is mounted rotatably on the stationary tube and meshes with the rack portion. A control lever is mounted pivotally on the stationary tube, and a pawl unit is mounted on the control lever. The pawl unit engages the ratchet wheel to transmit a forward turning force applied on the control lever to the ratchet wheel, thereby enabling the ratchet wheel to rotate in a direction for retracting the slide rod into the stationary tube, and disengages the ratchet wheel when a rearward turning force is applied on the control lever. Each of the leg support rods is mounted pivotally on the connecting frame at one end, and is provided with an ankle support at the other end.

15 Claims, 10 Drawing Sheets

LEG STRETCHING DEVICE

BACKGROUND OF THE INVENTION

1. Field of the Invention

The invention relates to a stretching device, more particularly to a leg stretching device for stretching leg muscles.

2. Description of the Related Art

Referring to FIGS. 1 and 2, a conventional leg stretching device 1 is shown to comprise upper and lower connecting plates 11, 12, a fixed shaft 13 connected fixedly to intermediate portions of the connecting plates 11, 12, and a pair of leg support rods 14, 15 connected pivotally and respectively to left and right portions of the connecting plates 11, 12. The fixed shaft 13 has a front connecting end 131 extending between the intermediate portions of the connecting plates 11, 12 and connected fixedly thereto, and a hand grip end 132 opposite to the front connecting end 131. The leg support rods 14, 15 are disposed on left and right sides of the fixed shaft 13, respectively. Each of the leg support rods 14, 15 has a front pivot end 141, 151 extending between a respective one of the left and right portions of the connecting plates 11, 12 and connected pivotally thereto, and an ankle supporting end 142, 152 opposite to the front pivot end 141, 151. Each of the leg support rods 14, 15 is longer than the fixed shaft 13, and forms an angle with the fixed shaft 13.

In operation, the user sits behind the leg stretching device 1 with his body and legs disposed adjacent to the fixed shaft 13 and the leg support rods 14, 15, respectively. Subsequently, the user spreads his legs apart so as to support his ankles on the ankle supporting ends 142, 152 of the leg support rods 14, 15, respectively. Then, the user leans forward so that his arms can grip the hand grip end 132 of the fixed shaft 13. By moving his body closer to the fixed shaft 13, the distance between the user and the connecting plates 11, 12 can be shortened, and the leg support rods 14, 15 will pivot outwardly about the front pivot ends 141, 151 to spread apart the user's legs to a larger extent, thereby stretching the leg muscles of the user.

The conventional leg stretching device 1 is disadvantageous in that there is no mechanism to support and prevent undesired movement of the user's body during operation of the leg stretching device 1. In addition, stretching of the leg muscles cannot be conducted effectively when the user releases the hand grip end 132 of the fixed shaft 13.

SUMMARY OF THE INVENTION

Therefore, the main object of the present invention is to provide a leg stretching device that is capable of overcoming the aforesaid drawbacks that are commonly associated with the prior art.

According to the present invention, a leg stretching device comprises a base unit, a connecting frame, a control mechanism, and a pair of leg support rods.

The base unit includes a stationary tube with front and rear end portions spaced apart from each other in a longitudinal direction, and at least one seat member mounted on the rear end portion of the stationary tube.

The control mechanism includes a slide rod, a ratchet wheel, a control lever, and a pawl unit. The slide rod has a frame connecting portion mounted non-rotatably on the connecting frame, and a rack portion opposite to the frame connecting portion and extending slidably into the front end portion of the stationary tube. The ratchet wheel is mounted rotatably on the front end portion of the stationary tube about a pivot axis transverse to the longitudinal direction, and meshes with the rack portion of the slide rod. The control lever is mounted pivotally on the front end portion of the stationary tube. The pawl unit is mounted on the control lever, engages the ratchet wheel to transmit a forward turning force applied on the control lever to the ratchet wheel, thereby enabling the ratchet wheel to rotate in a direction for retracting the slide rod into the stationary tube, and disengages the ratchet wheel when a rearward turning force is applied on the control lever.

The leg support rods are disposed respectively on opposite lateral sides of the slide rod. Each of the leg support rods includes a pivot rod body that has one end mounted pivotally on the connecting frame, and an ankle support that is mounted on the other end of the pivot rod body.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
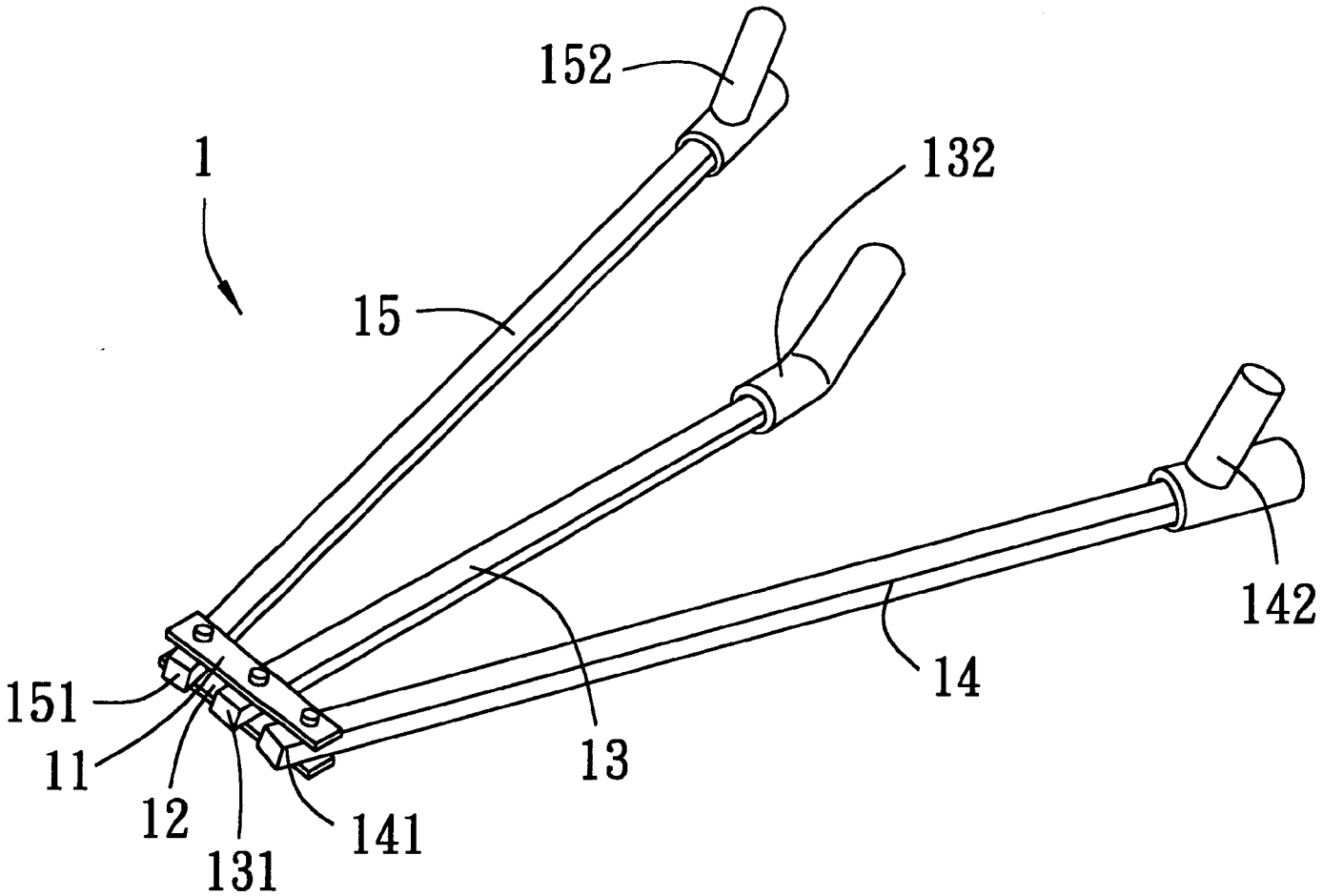
FIG. 1 PRIOR ART
FIG. 1 is a perspective view showing a conventional leg stretching device.
Figure 2:
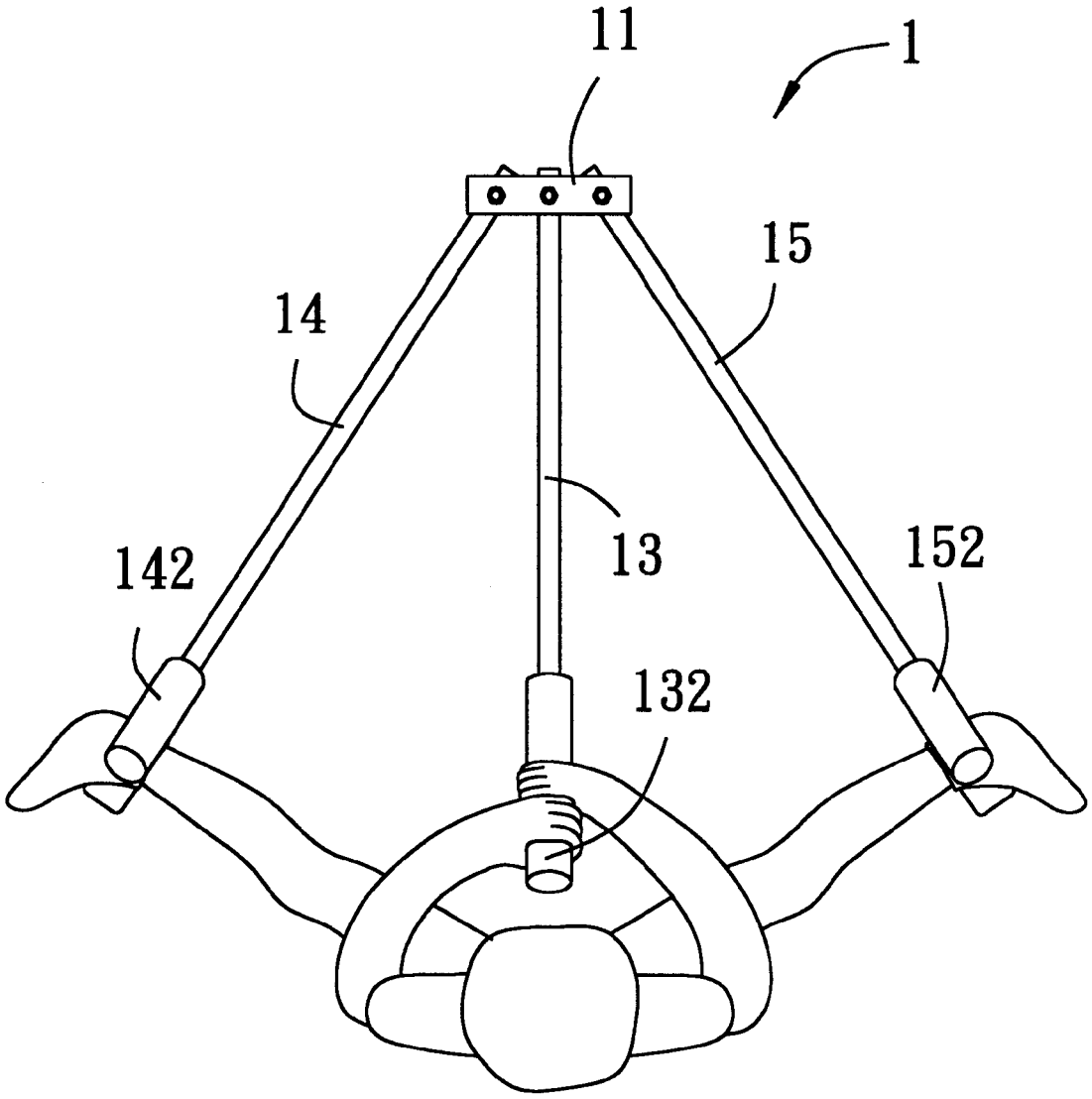
FIG. 2 PRIOR ART
FIG. 2 is a schematic top view illustrating the conventional leg stretching device of FIG. 1 in a state of use.
Figure 3:
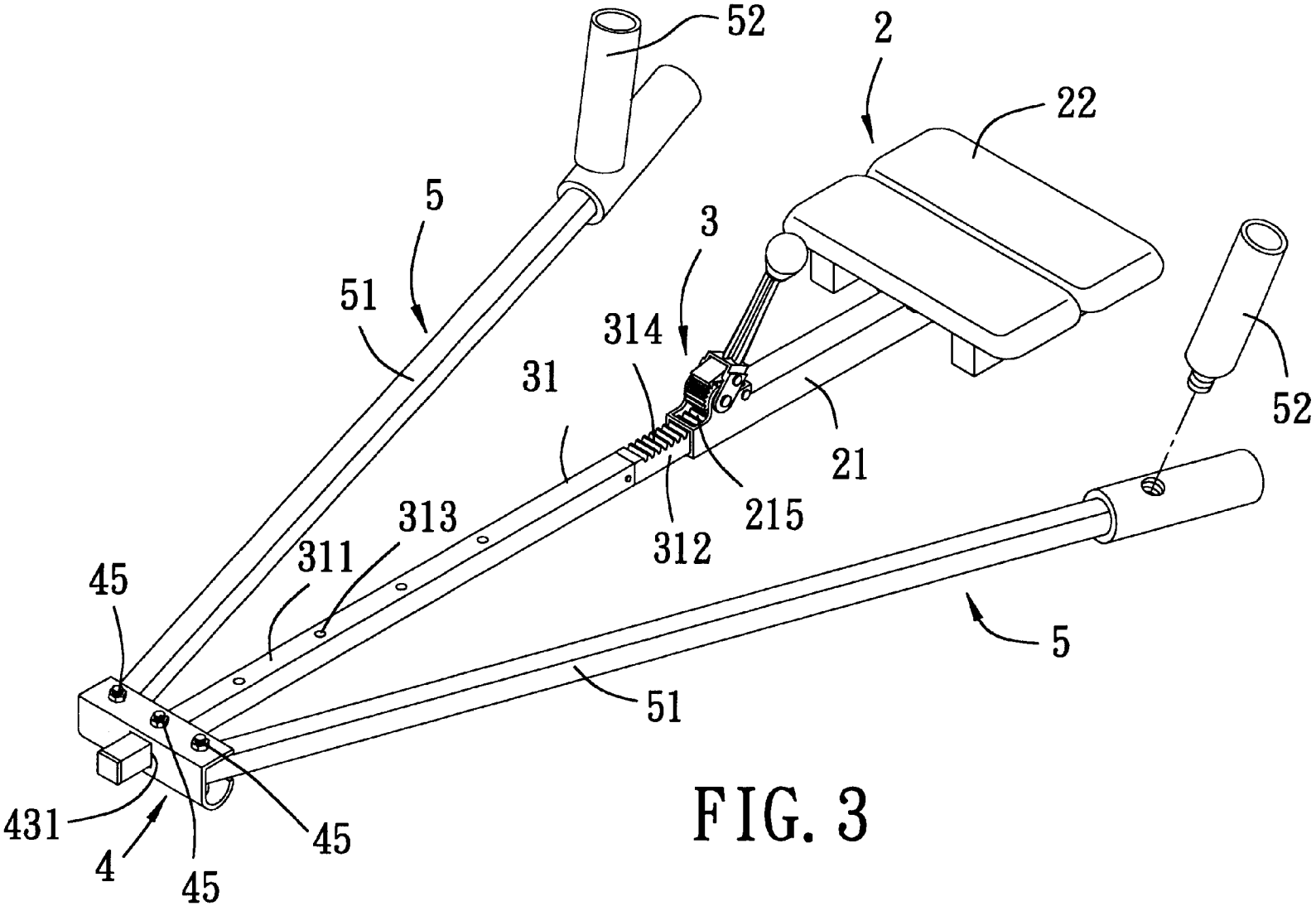
FIG. 3 is a perspective view showing the preferred embodiment of a leg stretching device according to the present invention.

Referring to FIG. 3, the preferred embodiment of a leg stretching device according to the present invention is shown to comprise a base unit 2, a control mechanism 3, a connecting frame 4, and a pair of leg support rods 5.

Figure 4:
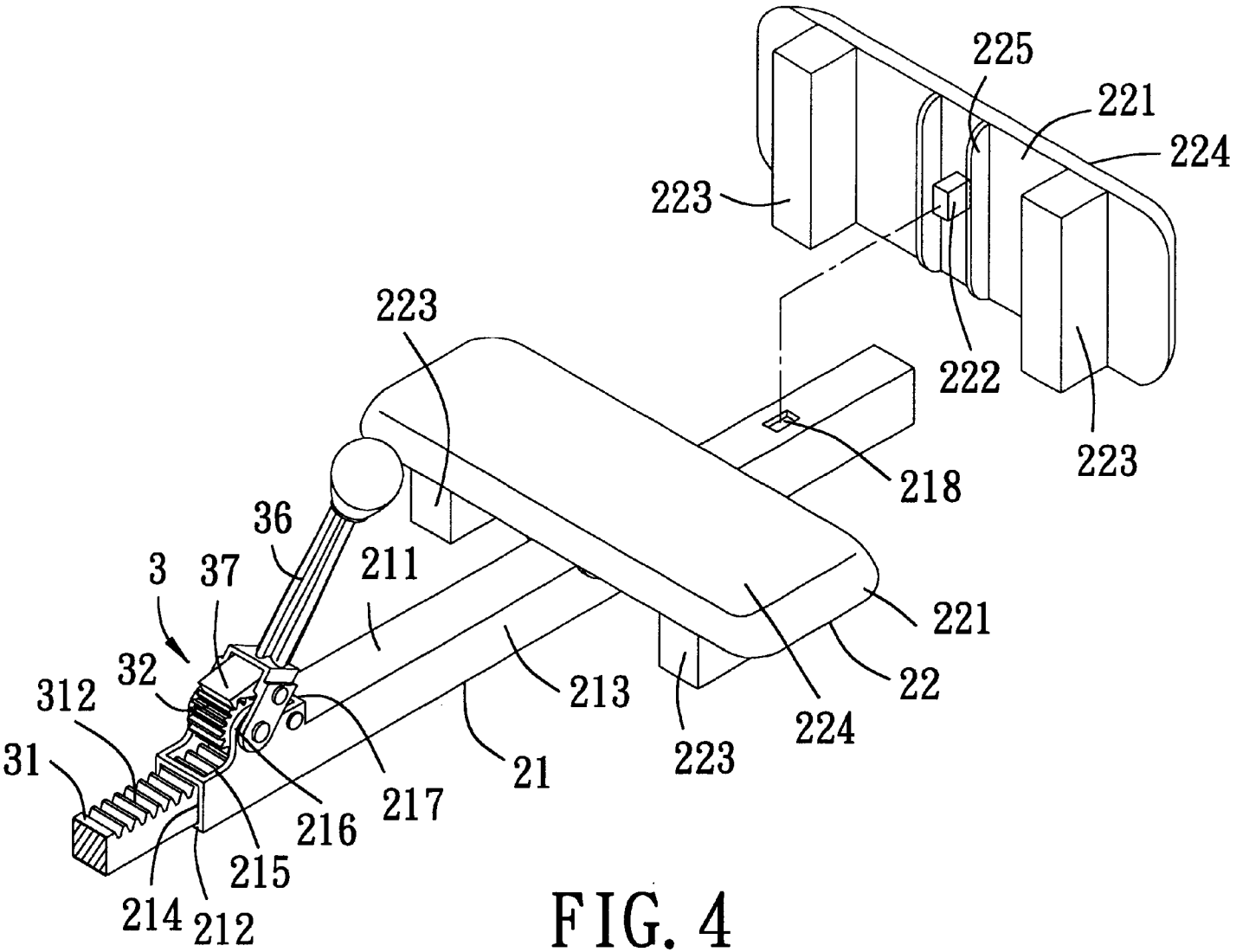
FIG. 4 is a fragmentary exploded perspective view showing a base unit and a control mechanism of the preferred embodiment.
Figure 5:
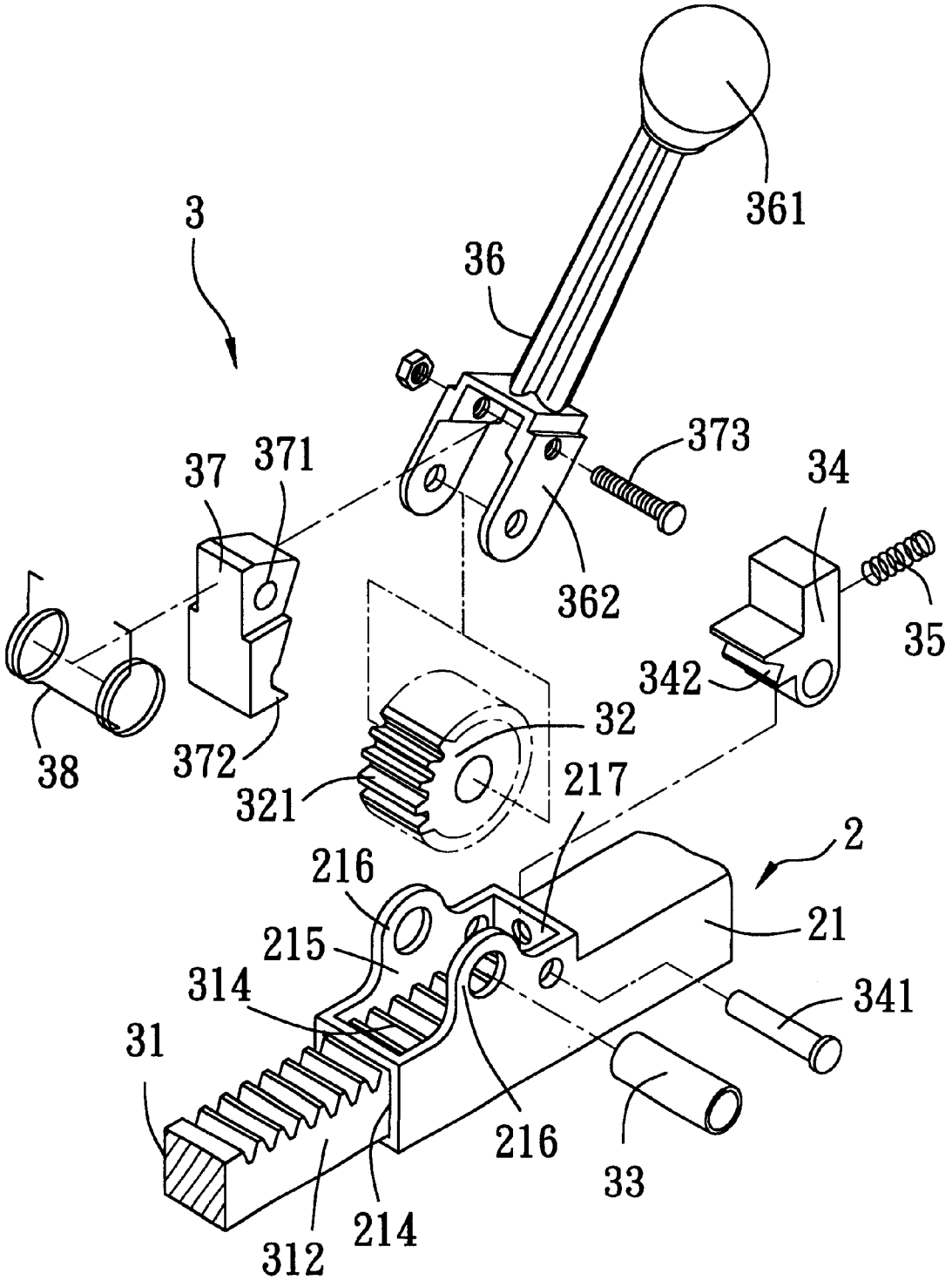
FIG. 5 is a fragmentary exploded perspective view illustrating the control mechanism of the preferred embodiment.

With further reference to FIGS. 4 and 5, the base unit 2 is shown to include a stationary tube 21 and seat members 22 mounted on the stationary tube 21. The stationary tube 21 has a horizontal bottom wall 212, a horizontal top wall 211 spaced apart vertically from the bottom wall 212, and left and right walls 213 that interconnect left and right edges of the top and bottom walls 211, 212, respectively. The walls 211, 212, 213 cooperate to confine a slide hole 214 with an open front end. The top wall 211 is formed with an opening 215 at a front end portion of the stationary tube 21 for access to the slide hole 214. The left and right walls 213 are formed with pivot lobes 216 that extend upwardly and that are disposed on left and right edges of the opening 215. A limiting wall 217 extends upwardly from the top wall 211, interconnects the pivot lobes 216, and is disposed at a rear edge of the opening 215 remote from the open front end of the slide hole 214 in a longitudinal direction. The top wall 211 is further formed with a number of insert holes 218 (only one is shown) in a rear end portion of the stationary tube 21.

Each seat member 22 includes a seat board 221 disposed on the top wall 211 at the rear end portion of the stationary tube 21, an insert post 222 that projects downwardly from the seat board 221 and that is inserted removably into one of the insert holes 218 in the top wall 211, and left and right leg posts 223 that extend downwardly from the seat board 221 and that are disposed on opposite lateral sides of the stationary tube 21 for supporting the seat board 221 on a ground surface. A seat cushion 224 is mounted on a top side of the seat board 221. A pair of limit plates 225 extend downwardly from the seat board 221 and are to be disposed adjacent to the left and right walls 213 of the stationary tube 21 so as to confine the rear end portion of the stationary tube 21 therebetween.

The number of seat members 22 on the stationary tube 21 can be varied to suit the user's requirements. When the user is seated on the seat members 22, the seat members 22 and the stationary tube 21 can be kept in a stationary state due to the weight of the user that is applied thereon.

Figure 6:
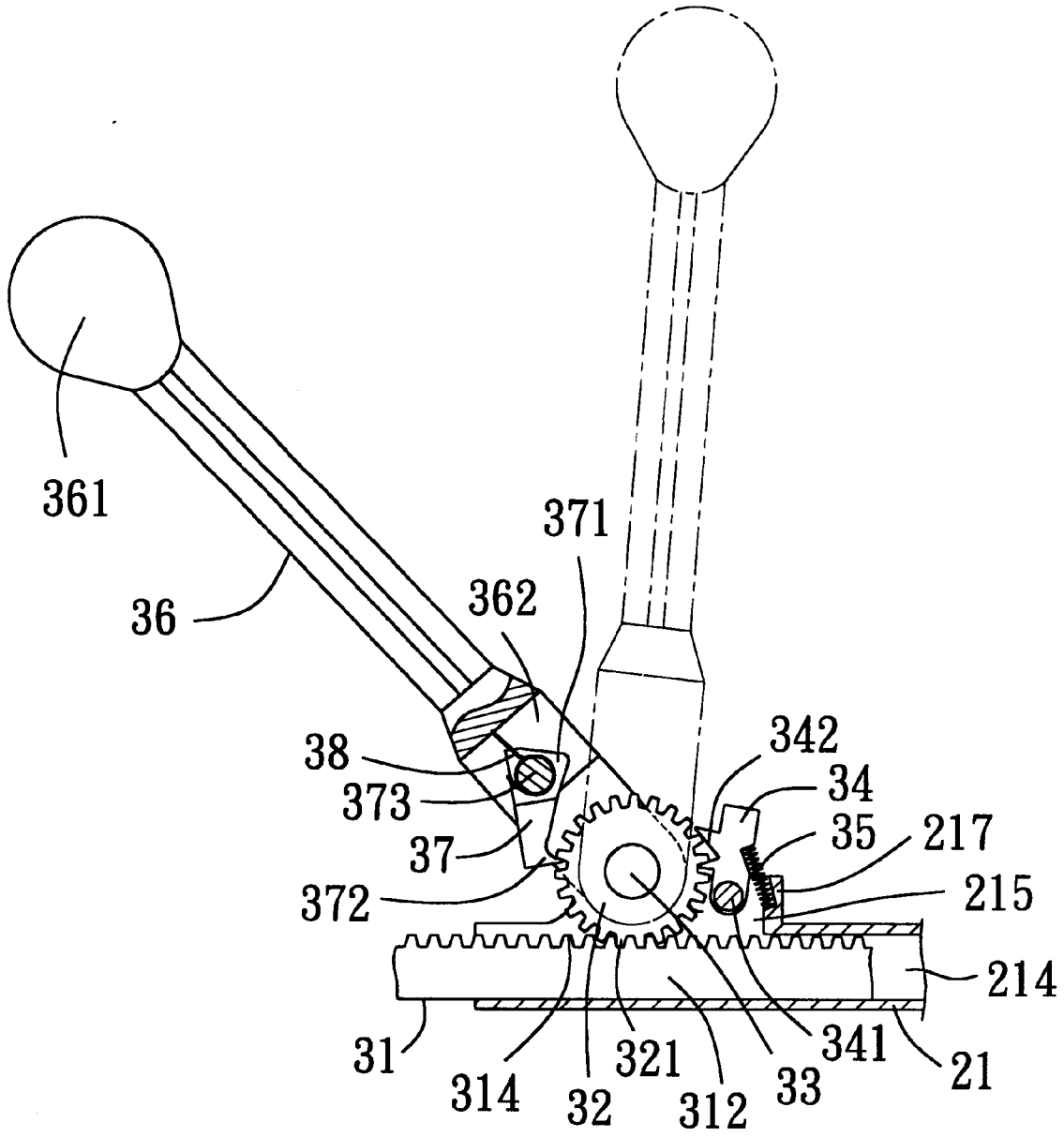
FIG. 6 is a fragmentary sectional view of the preferred embodiment, illustrating operation of the control mechanism when a control lever thereof is turned to a force transmitting position.

With further reference to FIGS. 5 and 6, the control mechanism 3 includes a slide rod 31 that extends slidably into the slide hole 214 in the stationary tube 21, a ratchet wheel 32 disposed in the opening 215 between the pivot lobes 216, a pivot shaft 33 for mounting rotatably the ratchet wheel 32 on the pivot lobes 216 about a pivot axis transverse to the length of the stationary tube 21, an arresting member 34 disposed pivotally in the opening 215 between the ratchet wheel 32 and the limiting wall 217, a control lever 36 mounted on the pivot shaft 33 so as to couple pivotally with the pivot lobes 216, and a pawl member 37 mounted pivotally on the control lever 36 for engaging the ratchet wheel 32.

The slide rod 31 has a frame connecting portion 311 and a rack portion 312 extending rearwardly from the frame connecting portion 311. The frame connecting portion 311 is formed with a plurality of upright mounting holes 313 that are spaced apart from each other in a longitudinal direction. The rack portion 312 extends slidably into the slide hole 214 at the front end portion of the stationary tube 21, and has a top side formed with teeth 314 for meshing with ratchet teeth 321 on the ratchet wheel 32. During manufacture, the slide rod 31 can be formed into a solid rod body or a hollow rod body. Alternatively, the frame connecting portion 311 can be formed as a hollow rod body, whereas the rack portion 312 can be formed as a solid rod body that is subsequently joined to the frame connecting portion 311. As shown in FIG. 6, when the ratchet wheel 32 rotates in a counterclockwise direction, the ratchet wheel 32 causes the rack portion 312 of the slide rod 31 to retract into the slide hole 214 in the stationary tube 21.

The arresting member 34 has a lower pivot section mounted pivotally on the left and right walls 213 of the stationary tube 21 within the opening 215 by means of a pivot pin 341 that is parallel to the pivot shaft 33. The arresting member 34 further has an upper engaging section extending upwardly from the lower pivot section, a front side of which is formed with a locking projection 342 for engaging the teeth 321 of the ratchet wheel 32 so as to arrest clockwise rotation of the ratchet wheel 32. This will be described in greater detail in the succeeding paragraphs. A biasing member 35 is disposed between the limiting wall 217 and a rear side of the upper engaging section of the arresting member 34, and biases the arresting member 34 to pivot toward the ratchet wheel 32.

The control lever 36 includes a hand grip portion 361 and a forked pivot portion 362 that extends downwardly from the hand grip portion 361 and that is connected to the pivot shaft 33. As such, operation of the hand grip portion 361 can result in pivoting movement of the control lever 36 about the pivot shaft 33.

The pawl member 37 has a pivot section 371 mounted pivotally on the pivot portion 362 of the control lever 36 by means of a fastener 373, and a pawl section 372 that extends from the pivot section 371 for engaging the teeth 321 of the ratchet wheel 32 when the pawl section 372 moves in the counterclockwise direction relative to the pivot shaft 33, thereby enabling rotation of the ratchet wheel 32 in the counterclockwise direction. The pawl section 372 slides along the teeth 321 of the ratchet wheel 32 and thus disengages the same when the pawl section 372 moves in the clockwise direction relative to the pivot shaft 33. In other words, clockwise movement of the pawl section 372 does not result in corresponding clockwise movement of the ratchet wheel 32. A torsion spring unit 38 is mounted on the control lever 36 and serves to bias the pawl member 37 to engage the pawl section 372 with the ratchet wheel 32.

Figure 8:
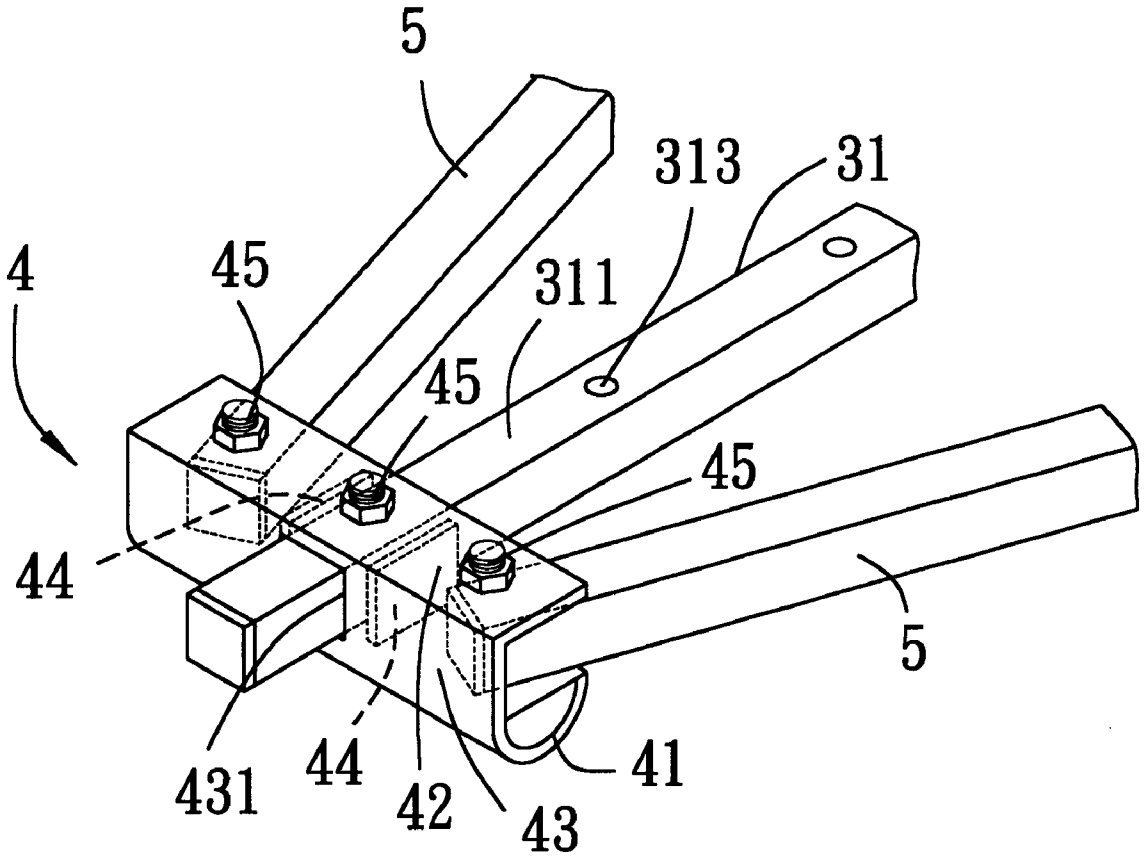
FIG. 8 is a fragmentary perspective view to illustrate a slide rod, a pair of leg support rods, and a connecting frame of the preferred embodiment.
Figure 9:
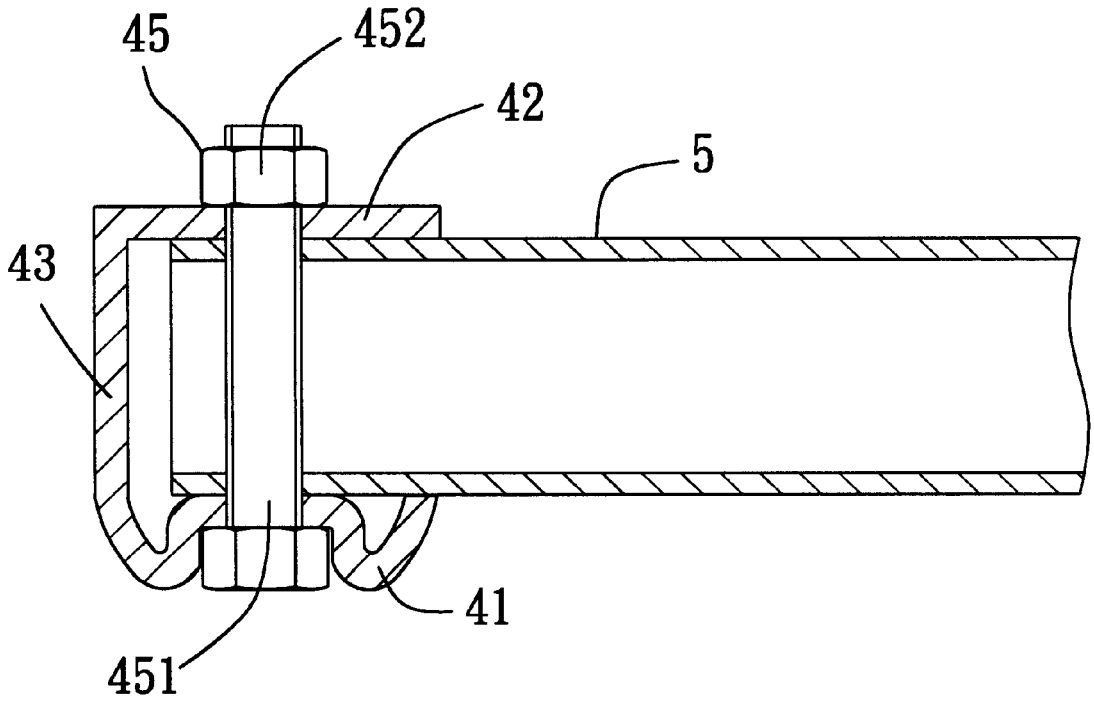
FIG. 9 is a fragmentary sectional view to illustrate the connection between the leg support rod and the connecting frame of the preferred embodiment.

With reference to FIGS. 8 and 9, the connecting frame 4 includes a curved lower plate 41, a flat upper plate 42 disposed above the lower plate 41, and a connecting plate 43 that interconnects front edges of the lower and upper plates 41, 42. Parallel partition plates 44 have upper and lower edges connected respectively to the upper and lower plates 42, 41 and configure the connecting frame 4 with left, right and intermediate compartments. The lower plate 41 has a generally convex bottom surface to facilitate movement of the connecting frame 4 on the ground surface. The connecting plate 43 is formed with a through-hole 431 that is communicated with the intermediate compartment. The frame connecting portion 311 of the slide rod 31 extends into the intermediate compartment and through the through-hole 431, and is disposed between the partition plates 44 so as to be restricted by the latter. A first one of three screw fasteners 45 includes a bolt member 451 that extends through the lower plate 41, a selected one of the mounting holes 313 in the frame connecting portion 311 of the slide rod 31, and the upper plate 42, and a nut member 452 that engages the bolt member 451, thereby fastening the slide rod 31 on the connecting frame 4 such that the distance between the control mechanism 3 and the connecting frame 4 is adjustable according to the length of the legs of the user.

As shown in FIGS. 3 and 8, the leg support rods 5 are disposed on left and right lateral sides of the slide rod 31, respectively. Each of the leg support rods 5 includes a pivot rod body 51 extending into a respective one of the left and right compartments in the connecting frame 4 at one end, and an ankle support 52 mounted on the other end of the pivot rod body 51. Second and third ones of the screw fasteners 45 also include a bolt member 451 that extends through the lower plate 41, the pivot rod body 51 of a respective one of the leg support rods 5, and the upper plate 42, and a nut member 452 that engages the bolt member 451, thereby mounting the leg support rods 5 pivotally on the connecting frame 4. Preferably, the bolt members 451 of the screw fasteners 45 have head portions that are sunk in the lower plate 41. The length of the pivot rod body 51 of each of the leg support rods 5 is at least equal to the length of the slide rod 31. Each leg support rod 5 forms an angle with the slide rod 31.

Figure 10:
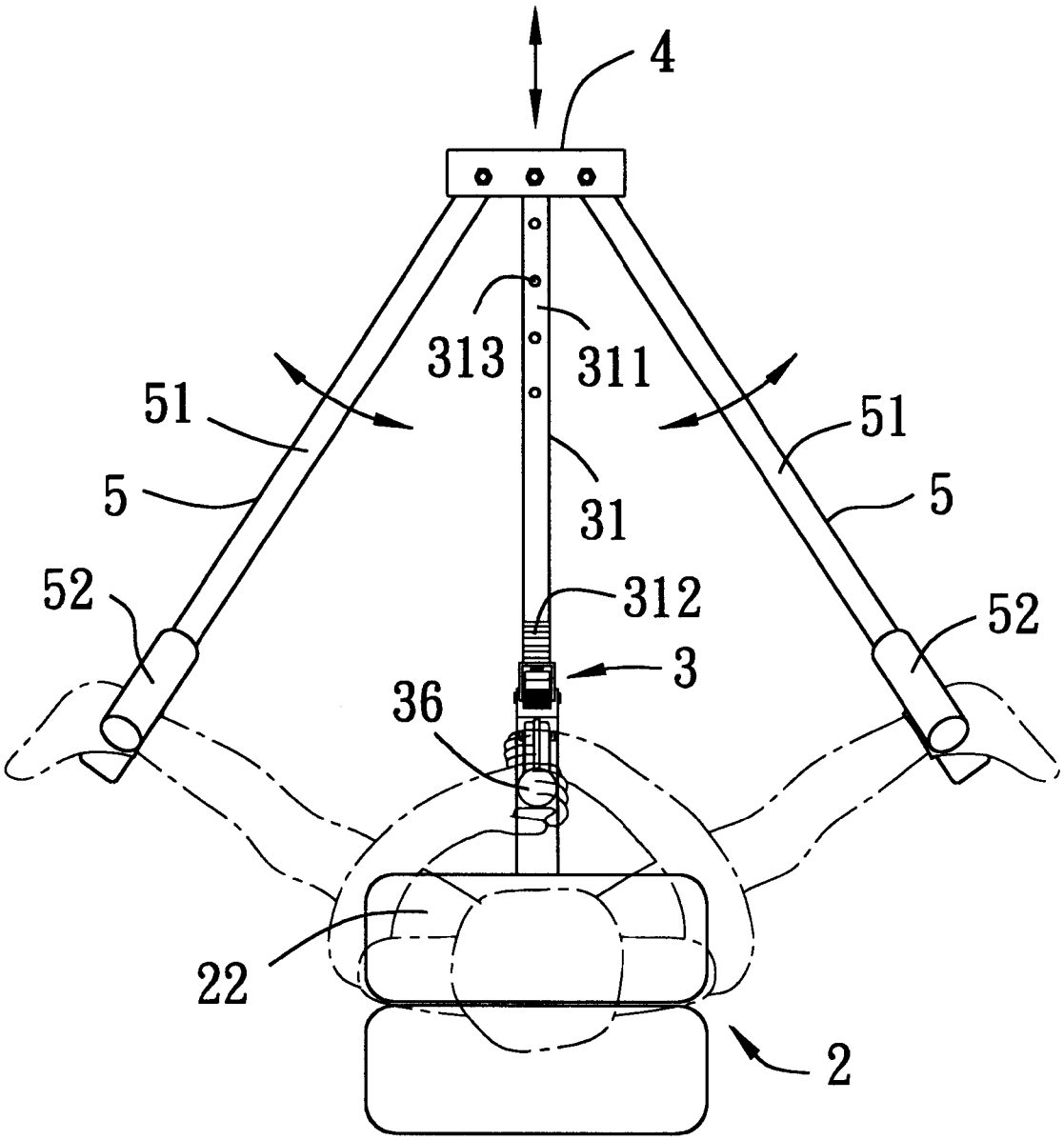
FIG. 10 is a schematic top view illustrating the preferred embodiment in a state of use.

Referring to FIG. 10, in operation, the user sits on the base unit 2 with his body and legs disposed adjacent to the control mechanism 3 and the leg support rods 5, respectively. Subsequently, the user spreads his legs apart so as to support his ankles on the ankle supports 52 of the leg support rods 5, respectively. Then, as shown in FIGS. 3 and 6, when a forward turning force is applied on the control lever 36 so as to turn the latter forwardly from a substantially vertical locking position (shown in dotted lines in FIG. 6) to a force transmitting position (shown in solid lines in FIG. 6), the pawl section 372 moves with the control lever 36 to turn in the counterclockwise direction relative to the pivot shaft 33. The pawl section 372 engages the teeth 321 of the ratchet wheel 32 such that the forward turning force is transmitted to the ratchet wheel 32, thereby enabling rotation of the ratchet wheel 32 in the counterclockwise direction. Note that the locking projection 342 on the arresting member 34 is configured so as not to arrest rotation of the ratchet wheel 32 in the counterclockwise direction. At this time, the ratchet wheel 32 causes the rack portion 312 of the slide rod 31 to retract into the slide hole 214 in the stationary tube 21, thereby reducing the distance between the user and the connecting frame 4. The leg support rods 5 will pivot outwardly about the corresponding screw fastener 45 with respect to the slide rod 31 to spread apart the user's legs to a larger extent, thereby stretching the leg muscles of the user.

Referring back to FIG. 6, when the control lever 36 is turned rearwardly from the force transmitting position back to the locking position due to the application of a rearward turning force thereon, the pawl section 372 moves with the control lever 36 to turn in the clockwise direction relative to the pivot shaft 33, whereby the pawl section 372 slides along the teeth 321 of the ratchet wheel 32 and thus disengages the ratchet wheel 32. The locking projection 342 of the arresting member 34 engages the ratchet wheel 32 to arrest rotation of the latter in the clockwise direction. As such, the slide rod 31 is prevented from moving relative to the base unit 2 under this condition to ensure continuity of the leg stretching exercise being performed by the user. The user can also perform arm and trunk extension and body twisting exercises at this time.

Figure 7:
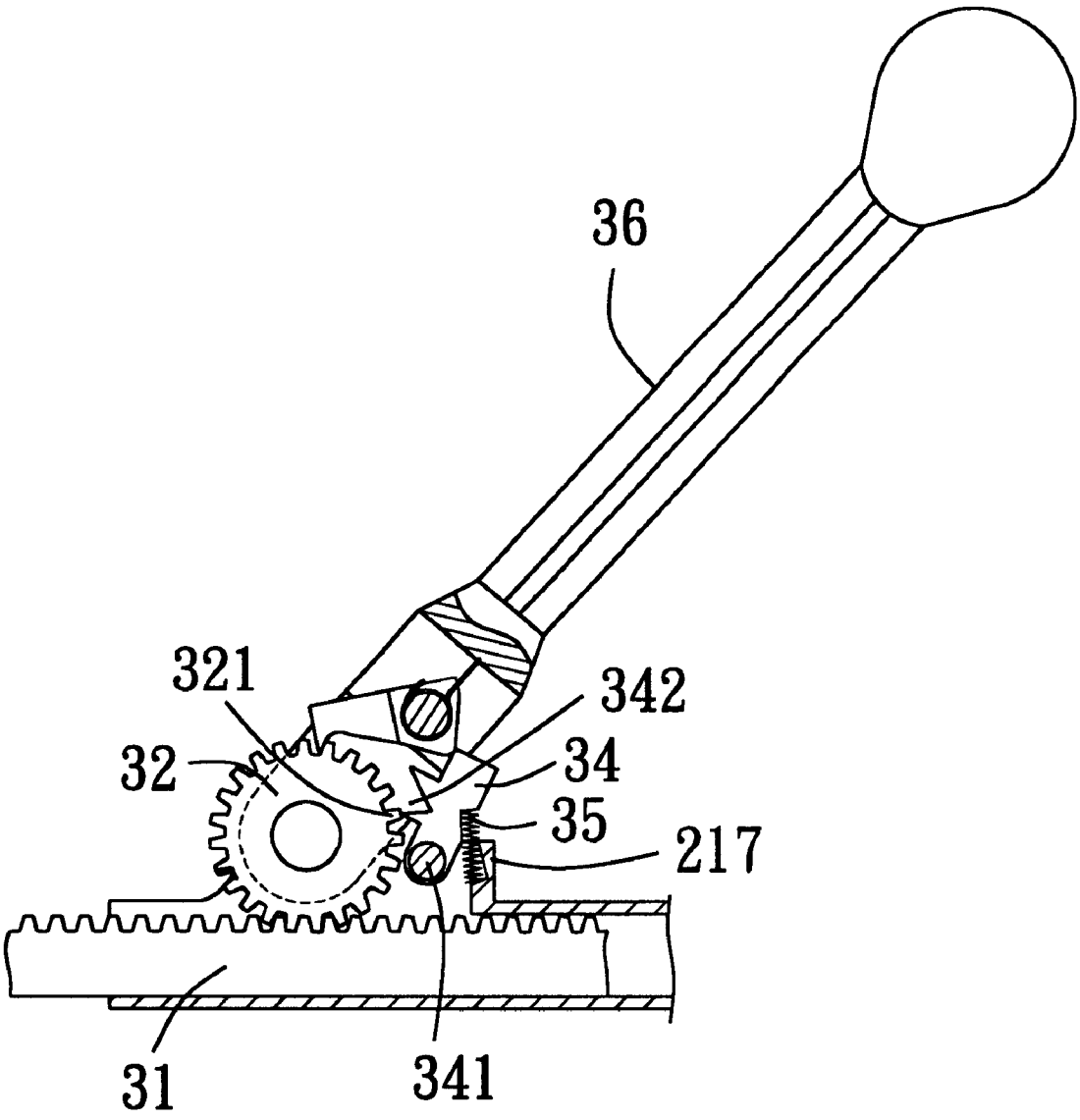
FIG. 7 is a fragmentary sectional view of the preferred embodiment, illustrating operation of the control mechanism when the control lever is turned to a releasing position.

Referring to FIG. 7, when the control lever 36 is further turned rearwardly relative to the stationary tube 21 from the locking position to a releasing position during application of the rearward turning force, the pivot portion 362 of the control lever 36 will eventually push the arresting member 34 to pivot rearwardly away from the ratchet wheel 32 and to abut against the limiting wall 217, thereby disengaging the locking projection 342 on the arresting member 34 from the teeth 321 of the ratchet wheel 32. At this time, the slide rod 31 can be pulled to extend out of the slide tube 21 for restoring the leg stretching device to an initial state.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A leg stretching device comprising:

a base unit including a stationary tube with front and rear end portions spaced apart from each other in a longitudinal direction, and at least one seat member mounted on said rear end portion of said stationary tube;

a connecting frame;

a control mechanism including a slide rod having a frame connecting portion mounted non-rotatably on said connecting frame, and a rack portion opposite to said frame connecting portion and extending slidably into said front end portion of said stationary tube, a ratchet wheel mounted rotatably on said front end portion of said stationary tube about a pivot axis transverse to the longitudinal direction, said ratchet wheel meshing with said rack portion of said slide rod, a control lever mounted pivotally on said front end portion of said stationary tube, and a pawl unit mounted on said control lever, said pawl unit engaging said ratchet wheel to transmit a forward turning force applied on said control lever to said ratchet wheel, thereby enabling said ratchet wheel to rotate in a direction for retracting said slide rod into said stationary tube, said pawl unit disengaging said ratchet wheel when a rearward turning force is applied on said control lever; and a pair of leg support rods disposed respectively on opposite lateral sides of said slide rod, each of said leg support rods including a pivot rod body that has one end mounted pivotally on said connecting frame, and an ankle support that is mounted on the other end of said pivot rod body.

2. The leg stretching device of claim 1, wherein said stationary tube is formed with top and bottom walls that are spaced apart vertically, and left and right walls that interconnect said top and bottom walls and that cooperate with said top and bottom walls to confine a slide hole with an open front end to receive said rack portion of said slide rod slidably therein, said top wall being formed with an opening at said front end portion of said stationary tube, said opening having a rear edge remote from said open front end of said slide hole in the longitudinal direction, said ratchet wheel being disposed in said opening, said control lever being turnable forwardly relative to said stationary tube from a substantially vertical locking position to a force transmitting position upon application of the forward turning force thereon, said control mechanism further including an arresting member movably disposed in said opening between said ratchet wheel and said rear edge of said opening, said arresting member permitting rotation of said ratchet wheel in said one direction when said control lever is in either of said locking position and said force transmitting position, and engaging said ratchet wheel to prevent rotation of said ratchet wheel in an opposite direction opposite to said one direction when said control lever is in said locking position.

3. The leg stretching device of claim 2, wherein said arresting member has a lower pivot section mounted pivotally on said stationary tube about a second pivot axis transverse to the longitudinal direction, and an upper engaging section extending upwardly from said lower pivot section, said upper engaging section having a front side formed with a locking projection that engages said ratchet wheel to prevent rotation of said ratchet wheel in said opposite direction when said control lever is in said locking position.

4. The leg stretching device of claim 3, wherein said upper engaging section further has a rear side opposite to said front side, said control mechanism further including a biasing member disposed between said rear edge of said opening and said rear side of said upper engaging section for biasing said arresting member to pivot toward said ratchet wheel.

5. The leg stretching device of claim 4, wherein said control lever is further turnable rearwardly relative to said stationary tube from said locking position to a releasing position upon application of the rearward turning force thereon, said control lever pushing said arresting member to pivot rearwardly away from said ratchet wheel so as to disengage said locking projection from said ratchet wheel and permit bi-directional rotation of said ratchet wheel when said control lever is in said releasing position.

6. The leg stretching device of claim 5, wherein said top wall is formed with an upwardly extending limiting wall at said rear edge of said opening to limit rearward pivoting movement of said arresting member when said control lever is moved to said releasing position.

7. The leg stretching device of claim 1, wherein said pawl unit includes:

a pawl member having a pivot section mounted pivotally on said control lever, and a pawl section that extends from said pivot section for engaging said ratchet wheel; and a torsion spring unit mounted on said control lever for biasing said pawl member to engage said pawl section with said ratchet wheel.

8. The leg stretching device of claim 1, wherein said connecting frame includes a lower plate and an upper plate disposed above said lower plate, said lower and upper plates having front edges, said connecting frame further including a connecting plate that interconnects said front edges of said lower and upper plates, said one end of said pivot rod body of each of said leg support rods and said frame connecting portion of said slide rod extending into said connecting frame and being disposed between said lower and upper plates, said leg stretching device further including three fasteners, each of which fastens a respective one of said one end of said pivot rod body of each of said leg support rods and said frame connecting portion of said slide rod onto said lower and upper plates of said connecting frame.

9. The leg stretching device of claim 8, wherein said connecting plate is formed with a through-hole that permits extension of said frame connecting portion of said slide rod therethrough.

10. The leg stretching device of claim 9, wherein said frame connecting portion is formed with a plurality of upright mounting holes that are spaced apart from each other in the longitudinal direction, one of said fasteners extending through a selected one of said mounting holes.

11. The leg stretching device of claim 8, wherein said connecting frame further includes a pair of parallel partition plates that have upper and lower edges connected respectively to said upper and lower plates and that restrict said frame connecting portion of said slide rod therebetween.

12. The leg stretching device of claim 8, wherein said lower plate has a generally convex bottom surface.

13. The leg stretching device of claim 1, wherein said rear end portion of said stationary tube has a top side formed with at least one insert hole, said seat member including:

a seat board disposed on said top side of said rear end portion of said stationary tube;

an insert post that projects downwardly from said seat board and that is inserted removably into said insert hole; and left and right leg posts that extend downwardly from said seat board, that are disposed on opposite lateral sides of said stationary tube, and that are adapted to support said seat board on a ground surface.

14. The leg stretching device of claim 13, wherein said seat member further includes a seat cushion disposed on top of said seat board.

15. The leg stretching device of claim 13, wherein said seat member further includes a pair of parallel limit plates that extend downwardly from said seat board and that confine said rear end portion of said stationary tube therebetween.

* * * * *